US005195928A

United States Patent [19]

Gigola

[11] Patent Number: 5,195,928

[45] Date of Patent: Mar. 23, 1993

[54] CENTRIFUGAL ACTUATING DEVICE FOR PUSHING OR PULLING AN ELEMENT TO BE OPERATED

[76] Inventor: Antonio Gigola, Via Quattro Novembre, 3, 25046 Cazzago San Martino (Brescia), Italy

[21] Appl. No.: 801,681

[22] Filed: Dec. 2, 1991

[30] Foreign Application Priority Data

Dec. 4, 1990 [IT] Italy ..... 5244 A/90

[51] Int. Cl.[5] ..... F24F 11/04

[52] U.S. Cl. ..... 454/352; 73/547

[58] Field of Search ..... 74/3, 25; 73/547; 454/341, 350, 351, 352, 353

[56] References Cited

U.S. PATENT DOCUMENTS

| | | | |
|---|---|---|---|
| 1,386,915 | 8/1921 | Underhill | 73/547 X |
| 2,444,257 | 6/1948 | Jenner | 73/547 X |
| 2,588,952 | 3/1952 | Baisch | 73/547 X |
| 2,700,538 | 1/1955 | Anderson | 73/547 |
| 3,942,422 | 3/1976 | Kawai | 454/353 X |
| 4,217,816 | 8/1980 | Manicelli | 454/351 |

FOREIGN PATENT DOCUMENTS

| | | | |
|---|---|---|---|
| 69507 | 5/1914 | Switzerland | 73/547 |
| 83118 | 11/1919 | Switzerland | 73/547 |
| 366440 | 2/1932 | United Kingdom | 73/547 |

*Primary Examiner*—Robert G. Nilson

*Attorney, Agent, or Firm*—Shlesinger, Fitzsimmons & Shlesinger

[57] ABSTRACT

A centrifugal device (17), in particular for operating shutters (20) disposed facing a fan (15), comprises a first end plate (23) connected to the end of a shaft (16) for rotating the fan (15). Facing said first plate (23) is a second end plate (24) rotatingly supporting, on an axis substantially coinciding with the shaft (16), a fastening element (19) for a control rod (18) which operates the mechanism when the two plates move away from and towards each other. The plates being linked to each other by at least three centrally articulated arms (26, 27) provided with counterweights (29) close to the central joint (28), on rotation of the shaft the centrifugal force acting on the counterweights (29) causing the central joints (28) to move apart from each other.

6 Claims, 5 Drawing Sheets

CENTRIFUGAL ACTUATING DEVICE FOR PUSHING OR PULLING AN ELEMENT TO BE OPERATED

The problem of pushing or pulling mechanical devices or apparatus in relation to a rotatory movement is well-known in many fields. For this purpose, actuating devices have been proposed comprising counterweights disposed on elements articulated so as to move a sleeve sliding on a shaft coaxial to the axis of rotation under the effect of the centrifugal thrust on the counterweights.

One particular problem, in the field of ventilating and aerating systems consists of automatically opening shutters when the fans positioned immediately behind them are turned on. Known centrifugal devices for automatically opening shutters comprise a shaft, an extension of the drive shaft of the fan, onto which is secured a linkage system which, when operated by the centrifugal force generated by rotation of the fan on two suitable opposing counterweights, causes a collar to shift axially along said shaft and in turn push open the shutters disposed in front of the fan.

Despite the fact that they achieve their purpose, the known devices present serious drawbacks. In fact, in numerous fields the speeds of rotations are extremely variable. For example, the fans must be able to rotate at different speeds, within a very wide range, depending upon the delivery of air required at any given moment.

To enable the actuating device to operate even at very low speeds the counterweights necessarily have to be very large. However, at higher speeds with heavy counterweights the device must be extremely well-balanced.

Even the slightest imbalance of the counterweights gives rise to very strong vibrations, which can cause considerable damage to the entire structure of the fan. In practice, devices such as the ones described above do not lend themselves to use, for example, whenever there are very wide variations in the speed of rotation, since they require excessively precise adjustment which is not always easy to obtain due to inevitable machining tolerances. Moreover, their strength and reliability are limited by the vibrations that they themselves generate. The scope of this invention is to obviate the aforementioned problems by providing a centrifugal actuating device, in particular for automatically opening shutters placed in front of a fan, which is self-centering and therefore intrinsically unaffected by imbalance and normal machining tolerances.

This scope is achieved, according to the invention, by providing a centrifugal device comprising articulated elements supporting counterweights which move apart from each other when it rotates to operate a mechanism connected to it, characterized by the fact of comprising a first end plate connected to the end of a shaft which rotates the device; disposed facing said first plate is a second end plate rotatingly supporting, on an axis substantially coinciding with the shaft, a fastening element for a control rod which operates the mechanism when the two plates move away from and towards each other; the plates being linked to each other by at least three centrally articulated arms provided with counterweights close to the central joint, on rotation of the shaft the centrifugal force acting on the counterweights causing the central joints to move apart from each other.

The innovatory principles of this invention and its advantages with respect to the known technique will be more clearly evident from the following description of possible exemplificative embodiments applying such principles, with reference to the accompanying drawings, in which.

Figure 2:
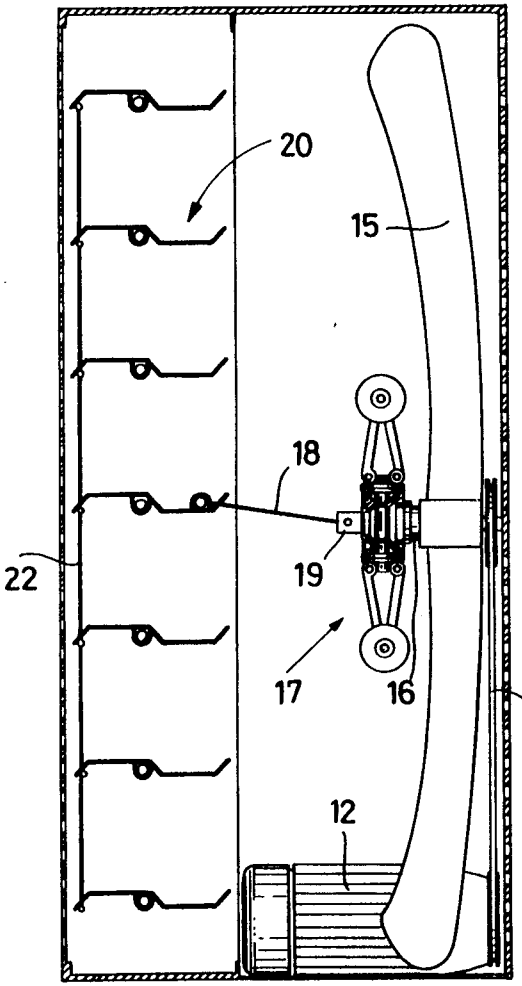
FIG. 2 shows a schematic partial cross-sectional side view of the device of FIG. 1 in an operating position.

With reference to the figures, a ventilating device 10 comprises a casing 11 inside which rotate, by means of a motor 12 and a belt drive 13, radial blades of a fan 15. Disposed at the end of the shaft 16 of the blades 15 is an automatic opening device 17, connected to shutters 20 by means of a control rod 18 secured to its operating end 19. In the non-operative position, shown in FIG. 1, the shutters, which are pivoted at the ends, are in a vertical position so as to substantially fit together with one another to close the air outlet 21 of the fan. In the open position, shown in FIG. 2, the shutters are held in a horizontal position by the device 17, thereby opening the air outlet 21. As can be clearly seen in FIG. 2, the shutters are interconnected by means of an element 22, so that when just one of them is operated the others are simultaneously and parallely shifted.

Figure 1:
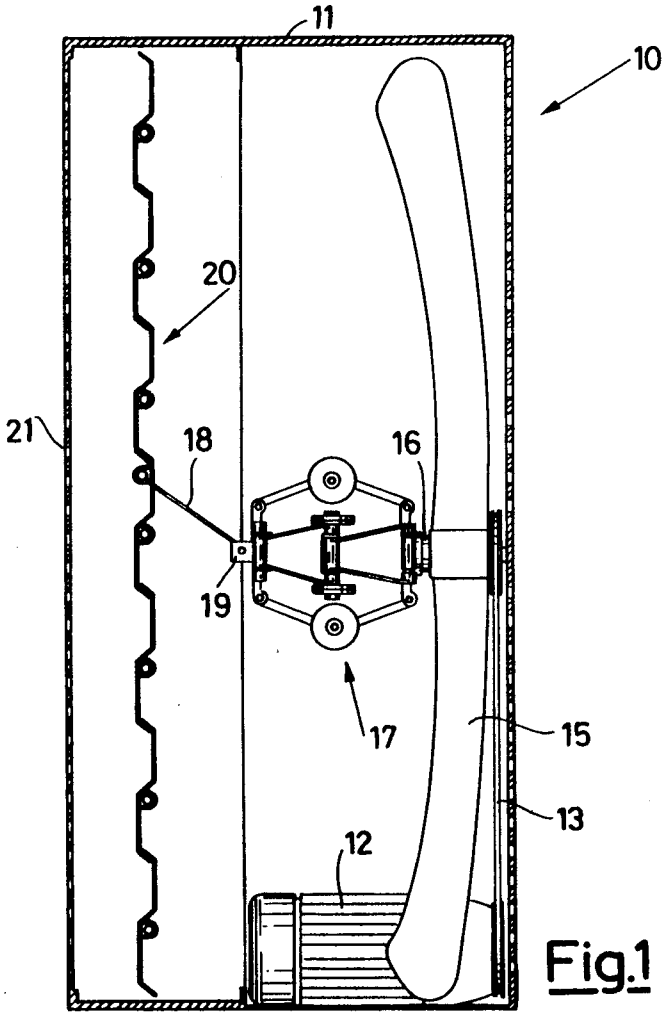
FIG 1 shows a schematic partial cross-sectional side view, in a non-operative position, of a fan with shutters fitted with an opening device made according to the innovatory principles of this invention.
Figure 3:
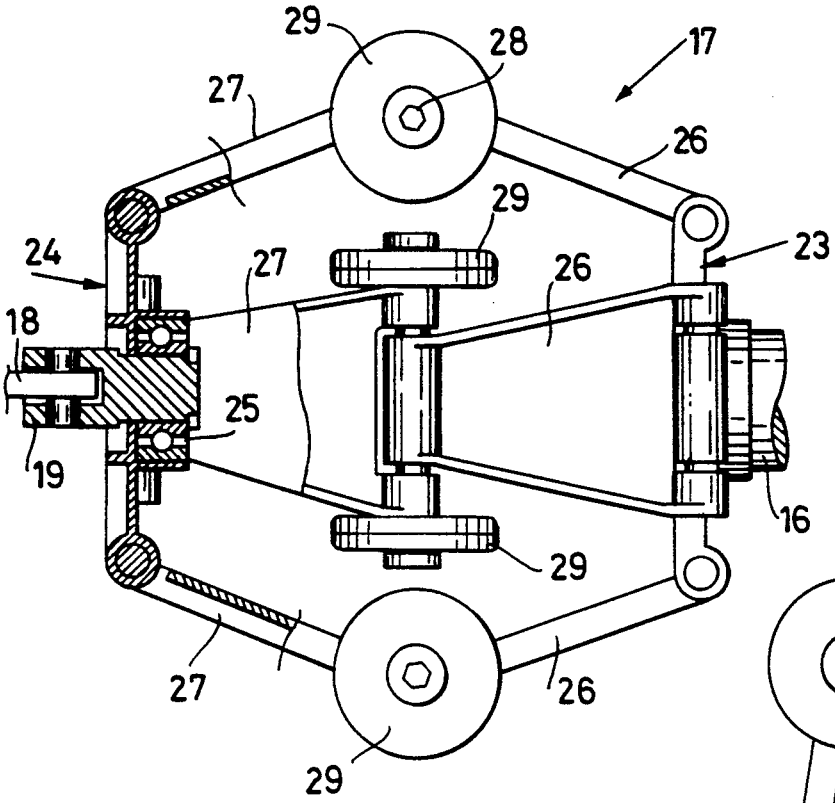
FIG. 3 shows an enlarged partial cross-sectional side view of the opening device of FIG. 1 in an non-operative position.
Figure 4:
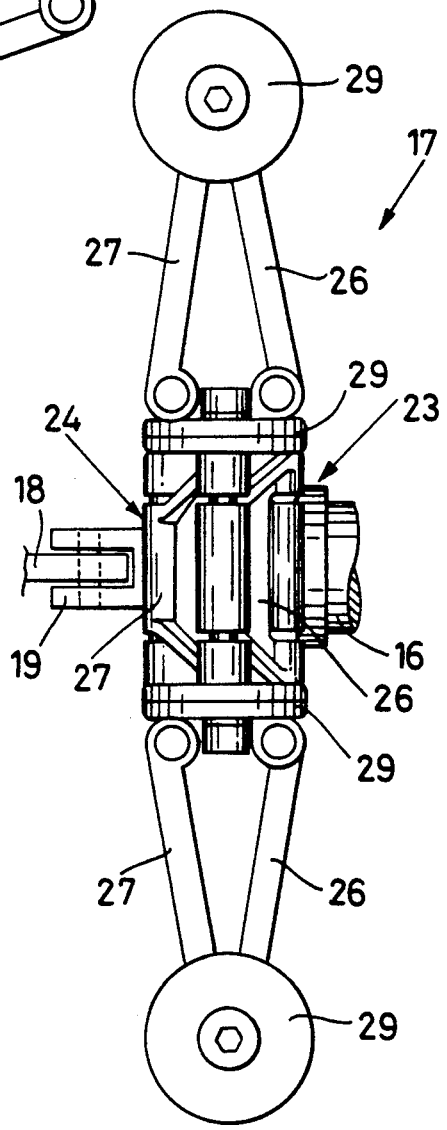
FIG. 4 shows a view similar to that of FIG. 3 but with the opening device in an operating position.
Figure 5:
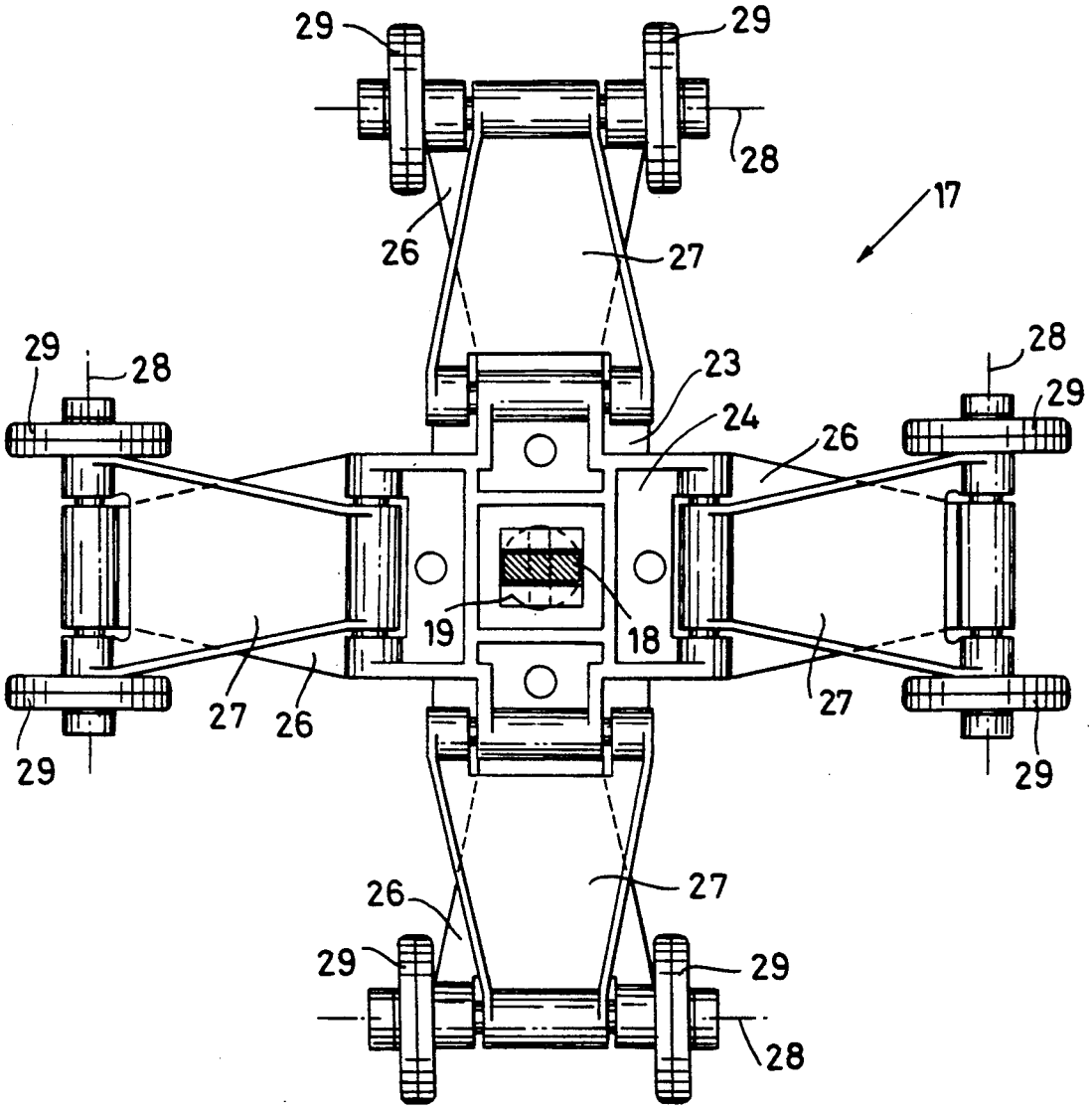
FIG. 5 shows a front view of the device as shown in FIG. 4.

FIG. 3 shows the opening device 17 in its non-operative position of FIG. 1. As can be seen in FIG. 3, the device 17 comprises a first end plate 23 secured to the end of the shaft 16 so as to rotate with it. A second opposing plate 24 supports, by means of a bearing 25, in a direction substantially coaxial to the shaft 16, the operating end 19 pivoted to the control rod 18. Pivoted to the sides of the two end elements or plates 23, 24 are respective arms 26, 27, with a central joint on pivot pins 28. As can be seen in FIG. 5, the arms pivoted to each end element are for example four in number, one for each side of the end elements. In this way, the element 24 can only move away from or towards the element 23 in a direction substantially coinciding with the axis of rotation of the fan, thus shifting from the position of FIG. 3 to the position of FIG. 4.

Disposed close to each pin 28 (at opposite ends thereof in the illustrated embodiment) reciprocally pivoting the arms 26 and 27 are counterweights 29 composed, for example, of metal disks. Thus, on rotation of the shaft 16 and, consequently, the device 17, its transition from the position of FIG. 3 to the position of FIG. 4 is caused by the centrifugal force on the counterweights 29, the plane passing through the central joints always substantially lying between the two plates.

Since the base or end plate 23 is the only connection between the device 17 and the shaft 16, the same centrifugal force acting on the counterweights 29 tends to keep them in a balanced position with respect to the axis of rotation due to the movements and deflections peculiar to the device itself. The device 17 is consequently self-centering and does not therefore require any fine adjustment. Contrary to the known technique, it is consequently possible to use even very heavy counterweights 29 without any danger whatsoever of causing vibrations during rotation. The device is thus able to operate just as efficiently at low speeds as it does at high speeds.

By providing counterweights 29 proportionate to the force required to open the shutters 20 it is possible to obtain a device 17 which opens the shutters even when the blades 15 revolve at very low speed. To reclose the shutters, it is sufficient to take advantage of the momemtum produced by their own weight around their axis of rotation (if necessary, providing suitable ballasting).

It is obvious that the arms connected to the end elements need not necessarily be four in number. It is sufficient to ensure the rigidity of the device apart from the possibility of movement between the two positions of FIG. 3 and FIG. 4.

Figure 6:
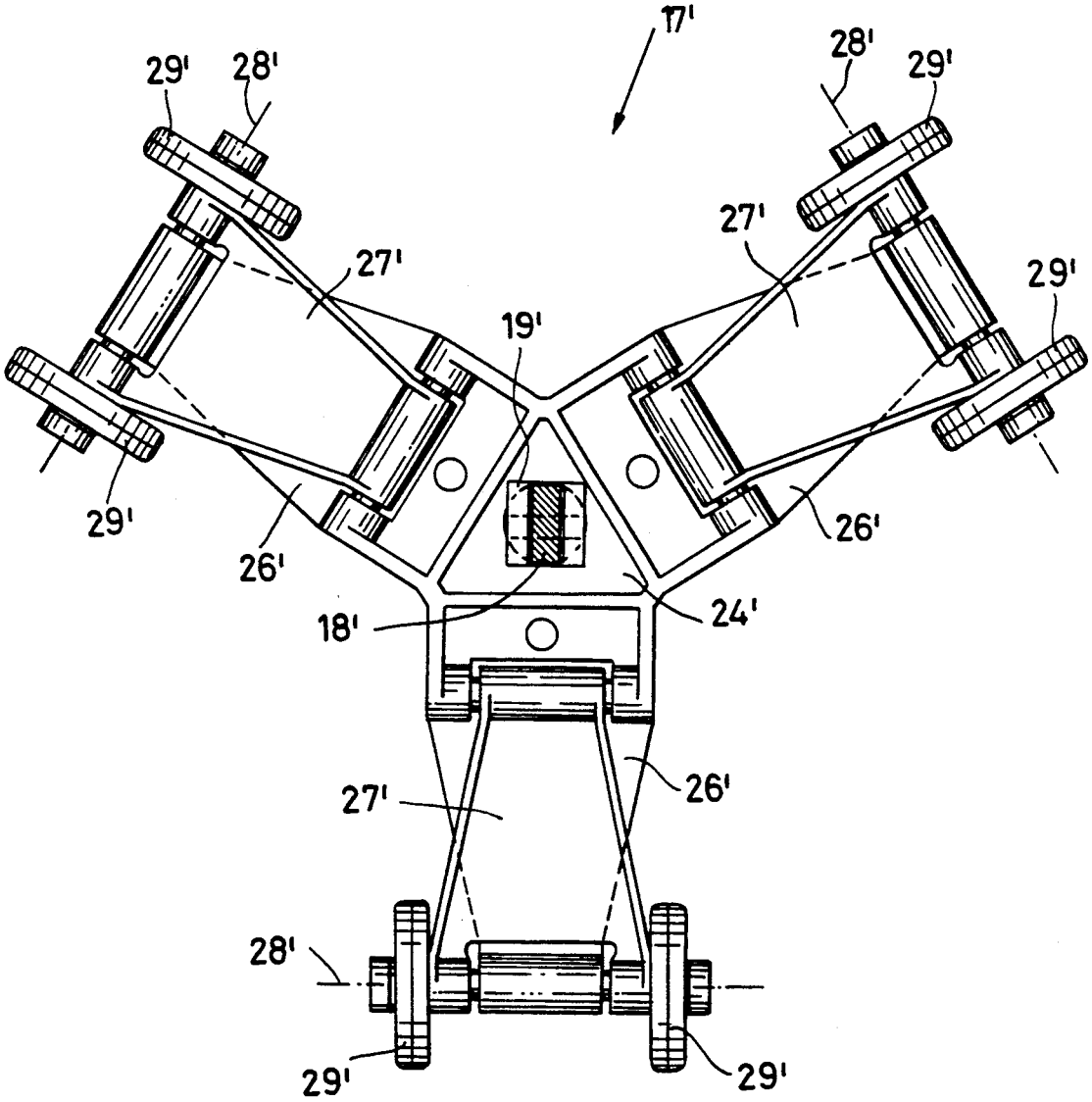
FIG. 6 shows a front view of a second possible embodiment of an automatic opening device applying the innovatory principles claimed herein.
Figure 7:
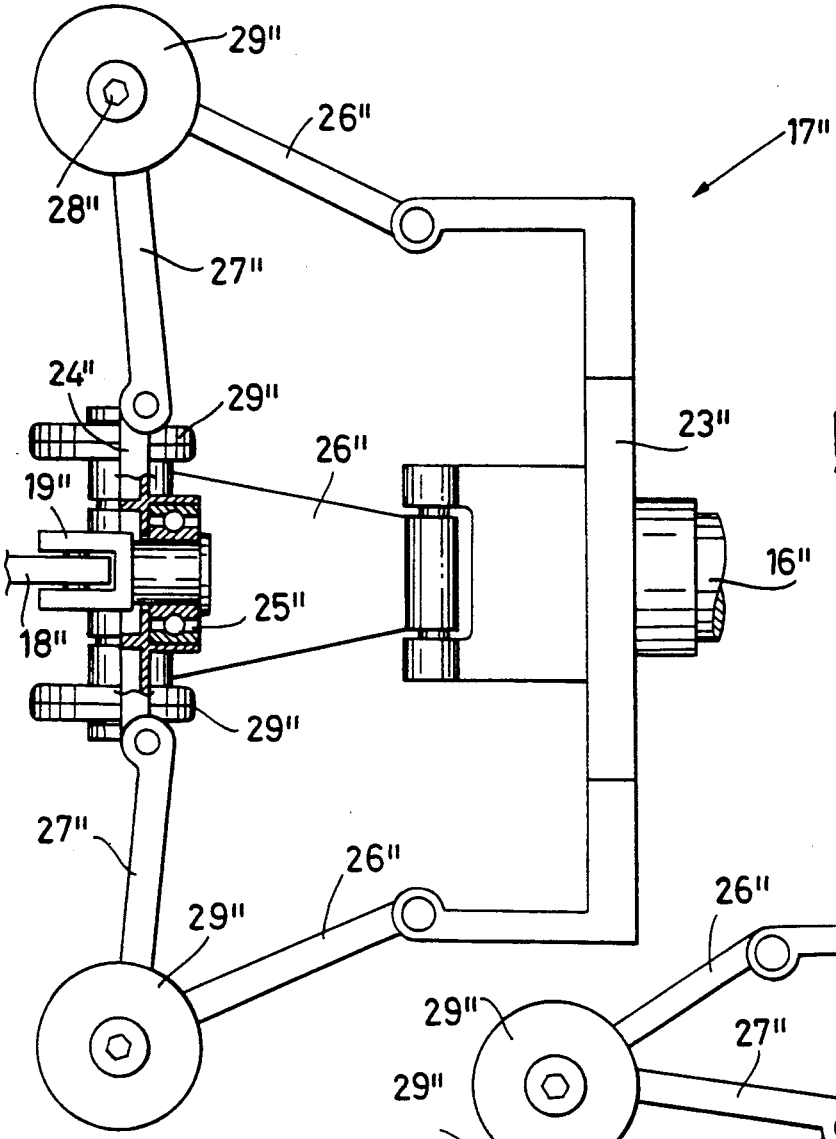
FIG. 7 shows a partial cross-sectional side view, in an operating position, of a third possible embodiment of an automatic opening device according to the invention.
Figure 8:
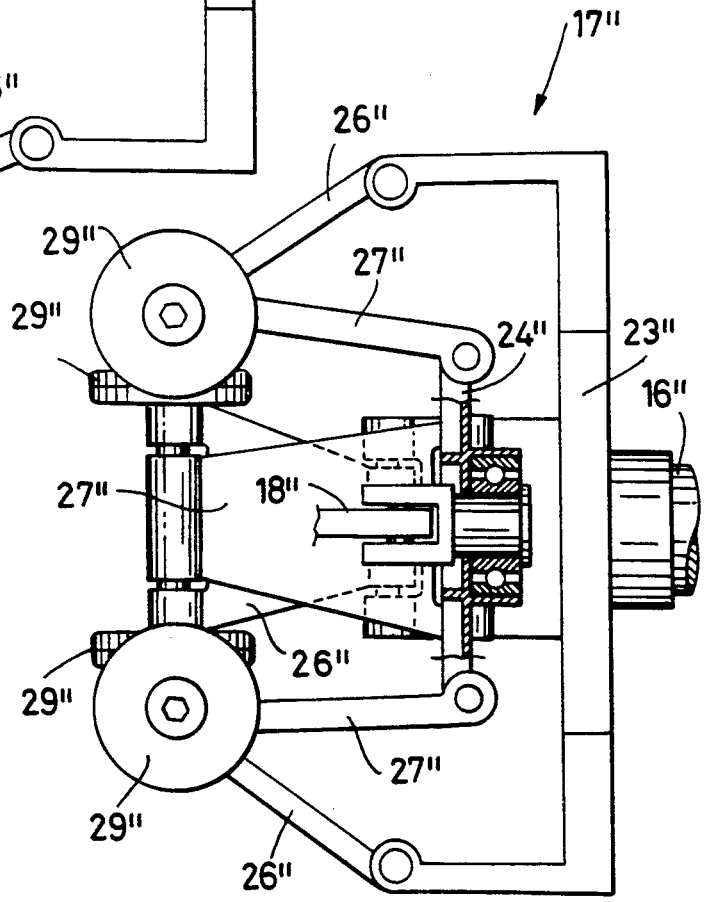
FIG. 8 shows a view similar to that of FIG. 7 but with the opening device in a non-operative position.

For example, FIG. 6 shows a device 17' (for convenience, identical numbering but with the suffix "prime" and subsequently "second" will be used to indicate parts similar to those of the preceding figures) having only three arms 26', 27' disposed at 120° from each other around generically triangular end elements 23', 24'. FIGS. 7 and 8, on the contrary, show a device 17'' having a different reciprocal disposition between the end elements 23'', 24'' and the arms 26'', 27''. With this different disposition, in which the central joints of the arms lie in a common plane which is always outside the space between the plates, the maximum distance of the counterweights 29'' from the axis of rotation is made to match the maximum reciprocal distance between the end plates 23'', 24''. FIG. 7 shows this device in the shutter opening position, while in FIG. 8 it is shown in the non-operative position. This way of operating is useful whenever it is necessary to open the shutters by pushing instead of by pulling as in the case of the device shown in FIGS. 1 and 2. In installing the device 17'', the control rod 18'' will, of course, be secured to the shutters in the opposite position with respect to that shown in FIG. 1, as will be obvious to any expert technician.

It will be clear at this point that the intended scopes are achieved by providing a device for automatically opening and closing shutters coupled to fans, which is structurally simple and self-centering, to enable it to operate efficiently and without vibrations within a wide range of operating speeds.

Both the end plates and the arms can advantageously be moulded from suitably sturdy plastic. Moreover, as can be clearly seen in FIGS. 3–5, the two end plates can be made identical in shape as can each pair of arms. In this way, two moulds are sufficient to obtain all the main parts of the device.

The foregoing description of an embodiment applying the innovatory principles of this invention is obviously given merely by way of example in order to illustrate such innovatory principles and should not therefore be understood as a limitation to the sphere of the invention claimed herein.

For example, the proportions between the various parts of the device can differ from those shown, just as the shape of the arms and the end plates can likewise differ.

I claim:

1. A rotatable centrifugal device comprising a plurality of articulated elements supporting counterweights which move apart from each other when the device rotates, thereby to operate a mechanism connected to said device, characterized by the fact that said device comprises a first end plate (23) connected to one end of a shaft (16) which is operable for rotating the device, a second end plate (24) disposed in spaced, confronting relation to said first plate and said one end of said shaft, and rotatingly supporting thereon, on an axis substantially coaxial with the axis of said shaft (16), a fastening element (19), a control rod (18) connecting said element to said mechanism to operate the mechanism when one of the two plates moves away from and towards the other plate, said plates being linked to each other solely by said articulated elements, which comprise at least three centrally articulated arms (26, 27) each of which is pivotally connected at opposite ends thereof to said plates and intermediate its ends to a central joint (28), said joints lying in a common plane and being provided with counterweights (29) operative in response to the rotation of said shaft and the consequent centrifugal force acting on the counterweights (29) to cause the central joints (28) to move apart from each other, and thereby to operate said mechanism.

2. Centrifugal device is claimed in claim 1, characterized by the fact that said plane passes through said central joints (28) and is substantially always contained between the two plates (23, 24), the plates (23, 24) being in the position where they are closest to each other when the counterweights (29) are in the position where they are furthest away from each other.

3. Centrifugal device as claimed in claim 1, characterized by the fact that said plane passes through the central joints (28) and is substantially always outside the space between said two plates (23, 24), the plates (23, 24) being in the position where they are furthest away from each other when said counterweights (29) are in the position where they are furthest away from each other.

4. Centrifugal device as claimed in claim 1, characterized by the fact that said arms (26, 27) are three in number and are disposed according to the vertices of an equilateral triangle.

5. Centrifugal device as claimed in claim 1, characterized by the fact that said arms (26, 27) are four in number and are disposed according to the vertices of a square.

6. In ventilating apparatus having a fan with blades (15) pointing substantially in a radial direction from a central rotating shaft (16), a plurality of shutters (20) being spaced from and facing said fan, and which are movable from a position in which they open to a position in which they close an air outlet (21) of the fan, the improvement characterized by a centrifugal device (17) secured to one end of said shaft for rotation thereby in the space between said fan and said shutters, and comprising a pair of plates, one of which is fixed to said one end of said shaft, means mounting the other of said plates for movement toward and away from said one plate and said one end of said shaft along an axis disposed substantially coaxially of said shaft, and a control rod rotatably connected at one end thereof to said other plate coaxially of said axis and connected at its opposite end to said shutters to operate said shutters upon rotation of said device, said mounting means comprising at least three centrally articulated arms each of which is pivotally connected at opposite ends thereof to one of said plates, and is pivotally connected intermediate its ends to one of at least three central joints, and means operative upon rotation of said shaft to cause said joints to move radially outwardly from said axis in a plane extending normal to said axis, and in equiangularly spaced paths about the axis of said shaft, thereby to move said other plate relative to said one plate and to effect the opening of said shutters.

* * * * *